United States Patent [19]

Klima

[11] 4,098,358

[45] Jul. 4, 1978

[54] DRILL BIT WITH HARD-FACED BEARING SURFACES

[76] Inventor: Frank J. Klima, 1401 W. Chestnut St., Virginia, Minn. 55792

[21] Appl. No.: 771,520

[22] Filed: Feb. 24, 1977

Related U.S. Application Data

[63] Continuation-in-part of Ser. No. 679,212, Apr. 22, 1976, abandoned.

[51] Int. Cl.[2] ..... E21B 9/10

[52] U.S. Cl. ..... 175/65; 175/337; 175/371

[58] Field of Search ..... 175/337, 57, 65, 340, 175/359, 371, 372, 339; 308/8.2

[56] References Cited

U.S. PATENT DOCUMENTS

| | | | |
|---|---|---|---|
| Re. 28,625 | 11/1975 | Cunningham | 308/8.2 |
| 1,816,203 | 7/1931 | Behnke | 175/337 |
| 2,249,578 | 7/1941 | Phipps | 175/340 |
| 2,325,745 | 8/1943 | Crum | 175/339 |
| 3,113,630 | 12/1963 | Williams, Jr. | 175/340 |
| 3,125,174 | 3/1964 | Medlock et al. | 175/340 X |
| 3,127,942 | 4/1964 | Neilson | 175/337 X |
| 3,216,513 | 11/1965 | Robbins et al. | 175/372 X |
| 3,866,987 | 2/1975 | Garner | 175/371 X |
| 3,921,735 | 11/1975 | Dysart | 175/337 |

*Primary Examiner*—James A. Leppink
*Attorney, Agent, or Firm*—Warren A. Sturm

[57] ABSTRACT

A rotary drill bit is provided with confronting large hard annular bearing surfaces on the journal-bearing body and on the journal-mounted conical cutter of the bit. The hard surfaces are generally normal to the axis of rotation of the cutter to bear axial loads, and provide a large bearing area resulting in relatively low unit pressures on the bearing surface. The hardness of the bearing surfaces should be greater than the hardness of the rock or other material being drilled. The journal and cutter may have confronting but spaced inner hard bearing surfaces which come into sliding, bearing contact with each other as the first-mentioned bearing surfaces are worn down. Cooling means are provided to cool the bearing surfaces, and an internal ball bearing and race assembly permits limited movement of the cutter axially on the journal to allow for wear of the bearing surfaces and to eventually bear axial loads. Also described is a nozzle means for sweeping cuttings to the periphery of the drill hole.

17 Claims, 8 Drawing Figures

DRILL BIT WITH HARD-FACED BEARING SURFACES

This is a continuaton-in-part of application Ser. No. 679,212, filed Apr. 22, 1976 now abandoned.

BACKGROUND OF THE INVENTION

Rotary drill bits of the type employed for drilling wells, blast holes and the like commonly employ two or three inwardly projecting cone-shaped rolling cutters which are rotatably mounted on journals carried by the body of the bit. The cutters have teeth or rock-crushing inserts on their conical surfaces, and are oriented by the journals to roll upon the bottom surface of the hole being drilled as the bit is rotated by the well string to which it is attached. A fluid, such as air, may be forced down the well string and discharged through the bit to flush cuttings upwardly in the well bore. The conical cutters commonly are mounted to the journals by means of both roller bearings and ball bearings, the roller bearings being subject to the radial forces imposed on the cutter during a drilling operation. In such operations, pulverized drill cuttings of rock or the like may find their way into the interior roller and ball bearings and cause undue bearing wear. Various methods have been suggested for preventing, or at least reducing, premature bearing wear; such methods include the use of seals to prevent pulverized rock cuttings from entering the bearing areas, or the use of lubricants, or compressed air flowing through an oblique channel to the bearings for lubricating and cooling the bearings and for sweeping pulverized rock away from the bearings. Representative of such bits are those described in U.S. Pat. Nos. 2,075,997; 2,076,002; 2,814,465; and 3,656,764.

The forces acting on such conical cutters during a drilling operation have both axial and radial components. Of these, the axial component was transmitted to the journal by means of the ball bearings, or by means of relatively small confronting frictional bearing surfaces interiorly of the bit, whereas the radial component was transmitted through the roller bearings. The heat generated at the bearing surfaces contributes materially to rapid bearing wear and premature failure.

BRIEF SUMMARY OF THE INVENTION

The present invention provides a rotary drill bit which is highly resistant to failure by axial loading, and a method for its use. The drill bit includes a body carrying a projecting journal, a rolling, conical cutter having an axially recessed open and receiving the journal, and interior antifriction bearings monting the cutter to the journal for rotation about the axis of the cutter. The rim of the conical cutter and the body adjacent the projecting journal are provided with respective outer large hard annular bearing layers having confronting surfaces which are in sliding contact at the open end or rim of the conical cutter and which are substantially normal to the axis of the cutter. The closeness of the outer bearing surfaces to the "mud", cuttings, or air forming the environment at the bottom of the hole being drilled facilitates heat transfer from the bearing surfaces to this environment to prevent the bearing surfaces from becoming overheated.

The cutter and journal also may be provided with respective hard inner bearing layers interiorly of the open end of the cutter and having confronting but spaced bearing surfaces substantially normal to the axis of rotation of the cutter. The latter, inner surfaces are spaced apart a predetermined distance so as to come into sliding, bearing contact with each other as the surfaces of the outer bearing layers become worn out before they have worn through.

The outer bearing surfaces may be so constructed and arranged as to pick up or entrain pulverized drill cuttings, and to utilize the pulverized cuttings as a lubricant between the bearing surfaces. The hardness of the bearing surfaces desirably is chosen so as to be greater than the hardness of the material being drilled. Cooling means are provided to cool the bearing surfaces, and may take the form of grooves in one or both of a pair of mating bearing surfaces through which air or other cooling medium may be circulated, the cooling medium flowing through the grooves in one surface serving to cool the opposed bearing area of the opposed surface.

The assembled journal body of the bit may be provided with a generally radially aligned slot so arranged as to cause air or the like to impinge upon the bottom of the hole, desirably at an appropriate angle to cause drill cuttings to be swept toward the periphery of the hole from whence they may escape upwardly.

DETAILED DESCRIPTION OF THE PREFERRED EMBODIMENT

Figure 1:
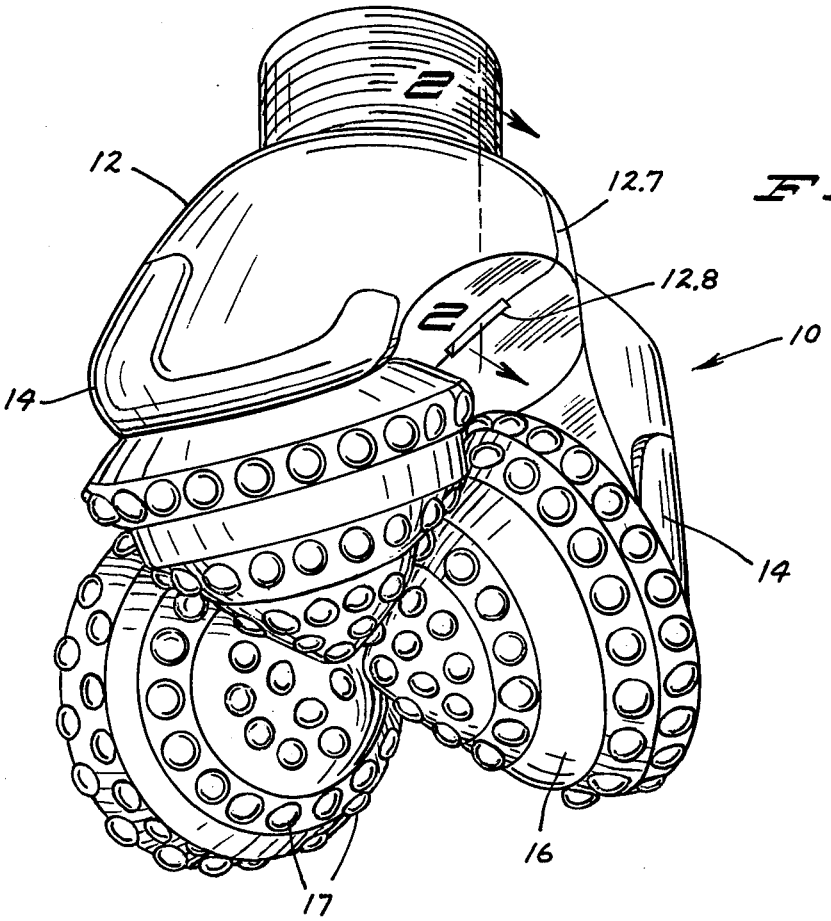
FIG. 1 is a partially schematic perspective view of a drill bit of the invention.
Figure 3:
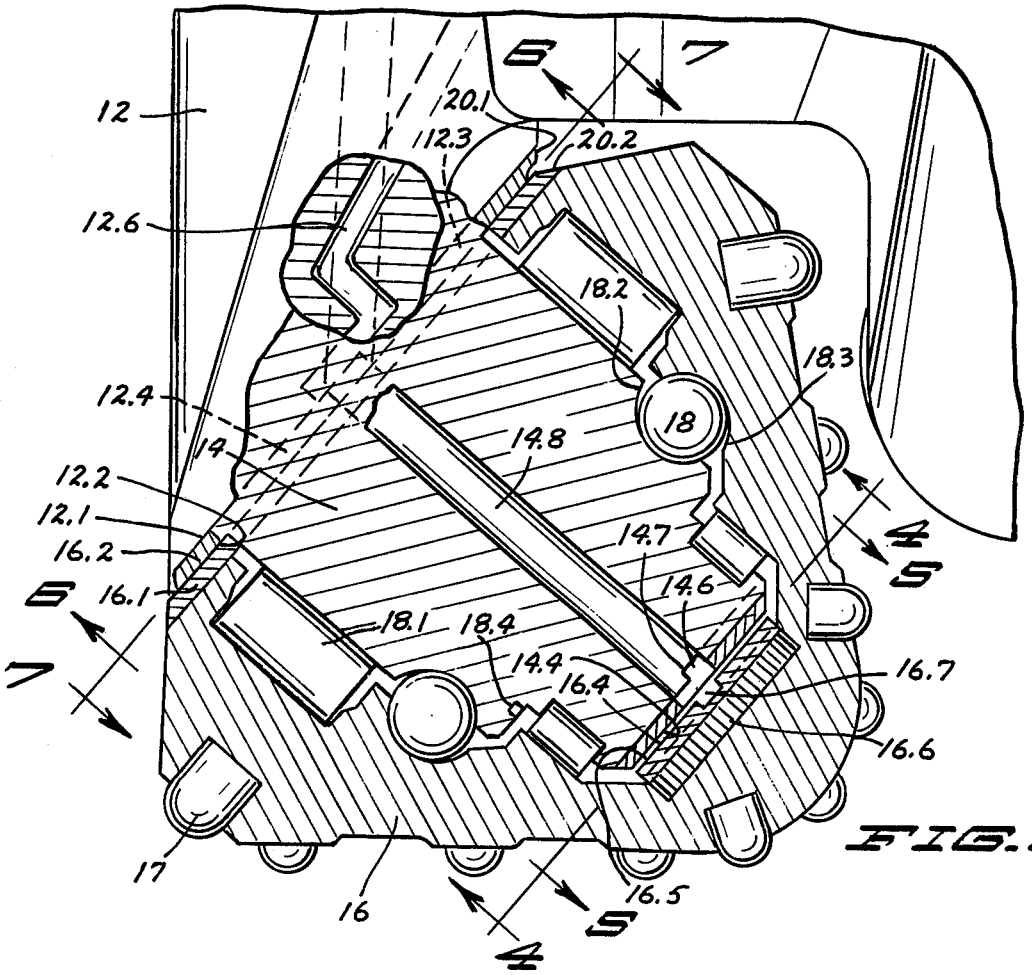
FIG. 3 is a broken away view, in partial cross section, of a drill bit of the invention.
Figure 4:
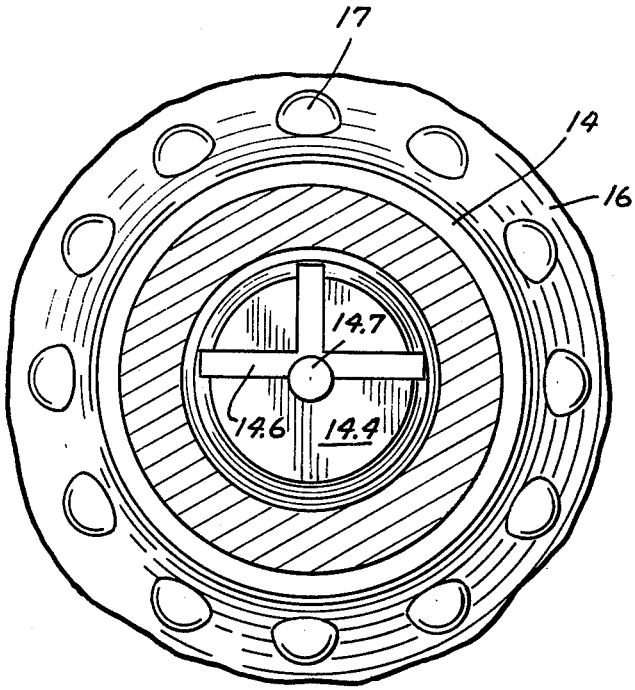
FIG. 4 is a broken away view taken along line 4—4 of FIG. 3.
Figure 5:
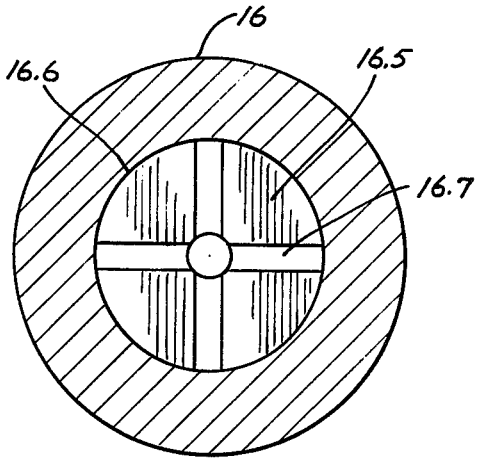
FIG. 5 is a broken away, cross-sectional view taken along line 5—5 of FIG. 3.

Referring first to FIGS. 1 and 3, a drill bit of the invention is designated generally as 10 and includes a body 12 having an upwardly threaded end which is threaded into the lower end of a drill string which rotates the bit in the hole being drilled, in the usual manner. At its lower end, the body is provided with one or more, usually three, journals 14 which respectively extend downwardly and inwardly from adjacent the periphery of the body. Rotatably mounted on each journal 14 is a rotating cutter 16, the cutter being generally conical in shape as shown in the drawing and having an axial recess at one end for reception of the journal 14. Antifriction bearings, such as ball bearings 18 and roller bearings 18.1 are provided internally between the cutter and the journal. The journal is angled with respect to the horizontal plane upon the floor of the hole being drilled as the bit is rotated. The cutter 16 is provided with hardened inserts 17, or teeth or the like for grinding and fracturing the material at the bottom of the hole. Compressed air or other drilling fluid is conveyned downwardly under pressure through the well string and bit, and operates to cool the interior bearings and to flush upwardly the resulting drill cuttings. For brevity, only a single journal 14 and conical cutter 16 are shown with the bit of FIG. 3.

Figure 7:
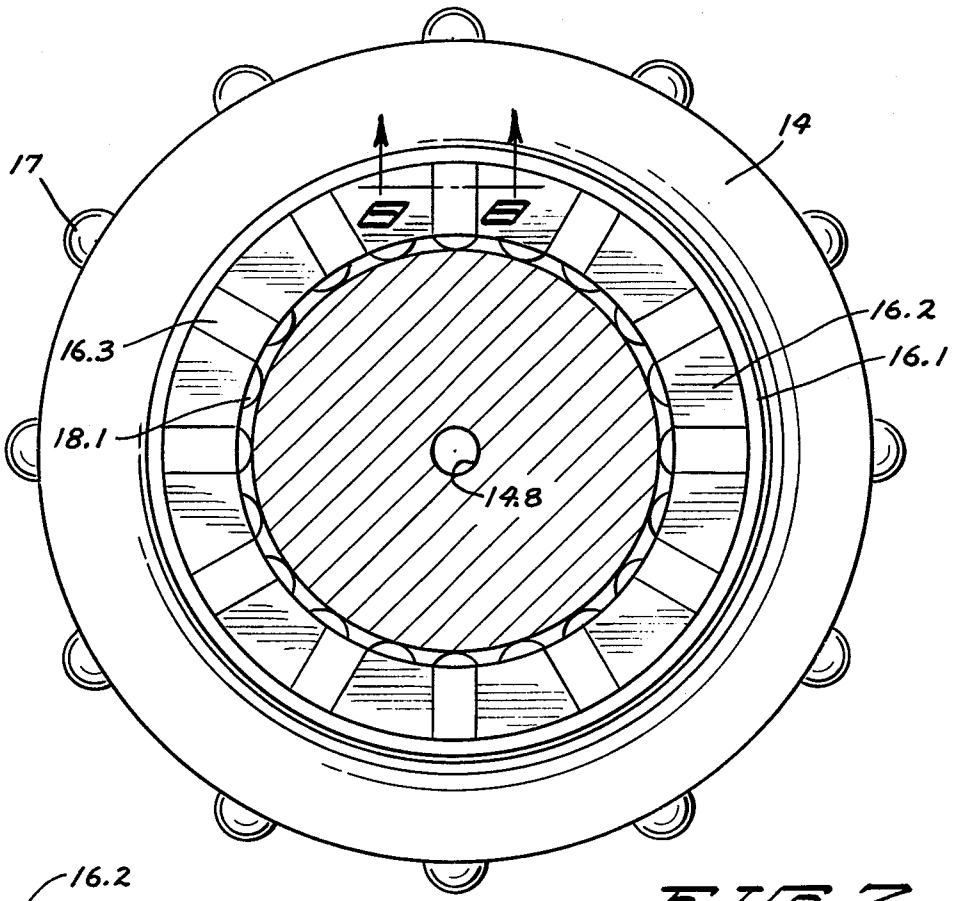
FIG. 7 is a broken away, cross-sectional view taken along line 7—7 of FIG. 3.
Figure 8:
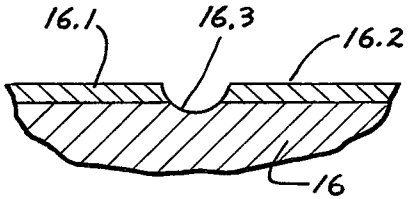
FIG. 8 is a broken away cross section take along line 8—8 of FIG. 7.

The rim of the conical cutter 16 at its open end is provided with a hard, annular bearing surface 16.2 which is normal to the axis of rotation of the conical cutter. Desirably, the surface 16.2 is the outer surface of an annular layer 16.1 of hard material. The layer may comprise a series of buttons or other geometric segments of hard material inserted into or brazed onto the cutter. The layer 16.1 in the drawing is depicted as solid and continuous. The layer 16.1 may be of a hard, friction-bearing alloy such as Stellite Haynes 92 (an iron based alloy of the Stellite Division, Cabot Corporation), or may be a carburized and hardened surface layer of the cutter itself. Desirably, the layer 16.1 has sufficient thickness to enable it to be worn away slightly during a drilling operation without significant change in the hardness of its outer, bearing surface. The body 12 of the bit is provided with a similar and complementary hard annular bearing layer 12.1 about the periphery of the journal 14, the bearing layer 12.1 having an outer surface 12.2 mating with and sliding against the annular bearing surface 16.2 at the rim of the cutter. One of the surfaces 12.2, 16.2, and preferably the cutter bearing surface 16.2 may be provided with a plurality of radial grooves 16.3 (FIGS. 7 and 8) which may have a generally rounded cross section as shown best in FIG. 3. The surface 16.2 of the cutter, at its lowest elevation, may project outwardly slightly from the surface 12.2 of the body as shown at 20 in FIG. 1, and the hard surface 12.2 (of the body) at its highest elevation may project beyond the outer periphery of the hard surface 16.2 of the cutter, as indicated at 20.1 in FIG. 1. The surface 20.1 may be relieved slightly by a step 20.2, if desired.

Figure 6:
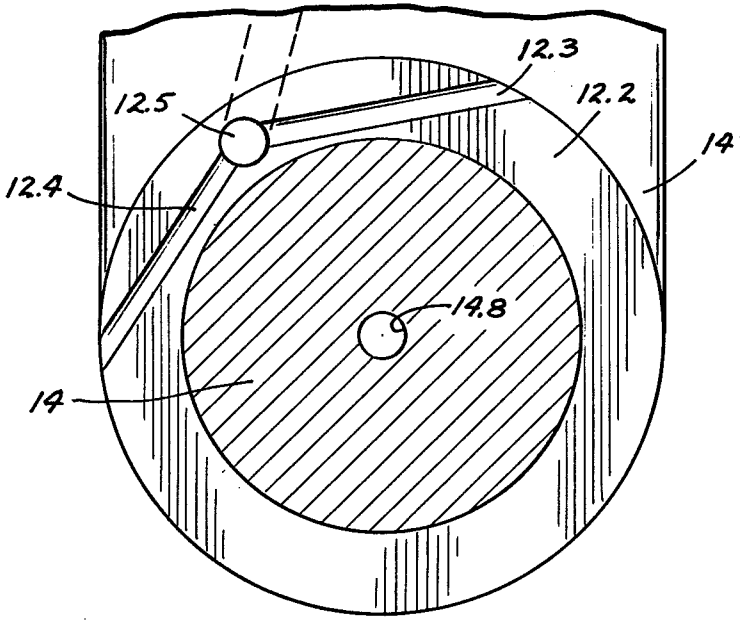
FIG. 6 is a broken away, cross-sectional view taken along line 6—6 of FIG. 3.

As shown best in FIGS. 3 and 6, the bearing layer 12.1 of the body 12 is provided with surface grooves 12.3, 12.4 which intersect at the mouth of a small bore 12.5 which leads thence generally upwardly through the body of the journal, as shown generally at 12.6 in FIG. 3, to a source of cooling fluid. As thus described, it will be understood that the cooling fluid flowing through the grooves 12.3, 12.4 cool the bearing surface 16.2 of the conical cutter, whereas the cooling fluid flowing through the grooves 16.3 in the bearing surface 16.2 of the cutter serves to cool the opposed bearing surface 12.2 of the journal body. It will further be understood that cooling fluid passing downwardly through the bore 12.5 in the journal body and which passes thence into the grooves 12.3, 12.4 is also thus permitted to enter the grooves 16.3 of the cutter.

The bearing surfaces 16.2, 12.2 desirably are provided with large bearing contact areas, and for this reason the outer diameter of the journal at the point where it protrudes from the body is made as small as practical engineering limitations will allow in order to maximize the radial width of the bearing surfaces 16.2, 12.2. For strength, the roller bearing 18.1 nearest the open end of the conical cutter desirably are recessed within the cutter rather than within the small diameter journal. The large bearing surfaces 12.2, 16.2 provide a bearing contact area which may be 200–500% greater than that provided by the inner thrust bearing surfaces 14.4, 16.5 which are discussed below, and the radial width of the bearing surface 12.2 can be made about 15% or more of the maximum outer diameter of the journal received in the cutter.

The inner surface of the conical cutter, at its bottom or innermost end, is provided with another hard bearing layer 16.4 having a generally flat bearing surface 16.5 which is normal to the axis of rotation of the cutter. The bearing layer 16.4 may be the upper, exposed surface of a button-like insert 16.6 which is held in a suitable recess at the innermost end of the conical cutter. The exposed, hard surface 16.5 of the button is provided with radially extending grooves 16.7 through which a cooling fluid may flow. The journal, at its point of deepest penetration into the conical cutter, is also provided with a hard bearing layer 14.2 presenting a hard bearing surface 14.4 in overlying and parallel relationship with the surface 16.5. Th confronting surfaces 16.5, 14.4 of the hard, internal bearing layers 16.4, 14.2 are parallel but are spaced slightly from one another, as shown best in FIG. 1. The bearing surface 14.4. is similarly provided with grooves 14.6 through which a cooling fluid may flow. The layers 14.2, 16.4 may be of the same material as the outer bearing layers 12.1, 16.1 or may similarly have carburized hardened surfaces.

The journal 14, at its innermost end, is provided with a central, axial recess designated 14.7 in FIG. 1. The recess 14.7 may define the lower end of a fluid passage 14.8 which extends axially of the journal and which may communicate with the interior of the well string to which the bit is attached. The space between the inner bearing surfaces 14.4, 16.5 is generally less than the thickness of either of the outer bearing layers 12.1, 16.1 so that as the outer bearing layers are worn down during a drilling operation, the inner surfaces 14.4, 16.5 come into sliding, bearing contact with one another before the outer hard layers have been worn through. The recess 14.7 at the inner end of the journal may contain a lubricant, or may serve as a relief space for the accumulation of debris from the slow wearing away of the inner bearing surfaces 14.4, 16.5. In the embodiment wherein the recess 14.7 defines the lower end of a fluid passage 14.8, a cooling fluid such as air may be forced downwardly through the well string and through the passage 14.8 to thence pass through the grooves 14.6, 16.7 to cool the respective surfaces 16.5, 14.4, the air flowing outwardly toward the open end of the cutter to cool, lubricate, and sweep debris from the antifriction bearings and eventually escaping through the radial grooves 16.3 in the outer bearing surface 16.2. One or more grooves 18.4 may be provided in the radially extending shoulders 15 supporting the roller bearings to facilitate movement of the cooling fluid in this manner.

From the foregoing description, and with the aid of the drawing, it will be understood that the grooves which are provided in opposing bearing surfaces 16.2, 12.2 and 14.4, 16.5 are so dimensioned and located with respect to one another as to avoid the possibility of the groove edges meeting and interfering with one another. Moreover, it will be understood that the grooves are made as small as practicable so as to retain the maximum working area for the bearing surfaces.

The antifriction bearings, and the recess in which they travel, are dimensioned so as to retain the cutter on the journal but to permit axial displacement of the cutter with respect to the journal in an amount at least equal to the initial spacing between the inner bearing surfaces 14.4, 16.5. From FIG. 1, it will be evident that the roller bearings 18.1 near the open end of the cutter, although retained in the races formed in the cutter, bear outwardly against a generally smooth, cylindrical surface of the journal and hence may slide axially of the journal. Similarly, the roller bearings 18.1 mounted in shallow races in the journal neat its innermost end bear upon smooth, cylindrical inner surfaces of the conical cutter and hence can move axially of the conical cutter.

The opposed races which are formed in the journal and cutter for reception of the ball bearings 18 are slightly elongated and are displaced axially from one another to permit some axial movement, as aforesaid, of the conical cutter with respect to the journal. FIG. 3 depicts the cutter and journal before any wear has taken place, and it will be noted that although the ball bearings 18 are snuggly seated within the races, the upper end 18.2 of the race formed in the journal is slightly enlarged or elongated, as is the generally downward portion 18.3 of the opposed race formed in the cutter. The elongation of the races is so controlled that the cutter may move smoothly axially of the journal as the outer bearing surfaces are worn down, and as the inner bearing surfaces similarly are thereafter worn, the bearings 18 subsequently coming into bearing engagement with the elongated portions 18.2, 18.3 of the opposed races to provide support against axial loads. In this manner, axial loads are continuously supported, first by the outer bearing surfaces 12.2, 16.2 until the surfaces wear away a sufficient amount to permit the inner bearing surfaces 14.4, 16.5 to bear an increasing share of the axial load. As the latter surfaces wear away, the ball bearings acting in their races begin to share in bearing the axial load.

In use, one selects a drill bit of the invention having outer bearing surfaces 12.2, 16.2 which desirably are substantially harder than the rock or other material to be drilled. In this manner, as drilling proceeds, drill cuttings may become entrained between these outer bearing surfaces to act as a lubricant for these surfaces and to prevent them from "welding" together under heat and pressure. In addition, these surfaces are mutually cooled by the cooling fluid passing through their face grooves. Entrainment of drill cuttings between the surface is facilitated by the grooves 16.3 formed on the outer bearing surface 16.2 of the cutter 16. Any drill cuttings which may thus act as a lubricant are prevented from reaching the interior antifriction bearings, of course, by the flow of air or other fluid through the passage 14.6 as described above.

The employment of large hard bearing surfaces at the rim of the cutter acts to increase the life of the bit, in that these surfaces act to maintain the rolling cutter coaxial with the journal and hence may relieve to some extent the radial pressure on the internal roller bearings. Further, heat generated by the frictional bearing surfaces at the open end of the cutter is transferred readily to the closely adjacent mud, cuttings, air, or the like forming the environment at the bottom of the hole being drilled, thus preventing these bearing surfaces from becoming overheated. In comparison, the small contact area afforded by thrust bearings of prior art bits results in very high unit loadings (e.g., lbs./square inch of bearing area), and this in turn may lead to localized overheating and deterioration of the bearings. The relatively low unit loading of the outer bearing surfaces of my drill bit (due to the large bearing contact area), and the location of these bearing surfaces in position to be readily cooled by the environment at the bottom of a hole, tend to prevent localized overheating and consequent destruction, and hence increase the useful life of the bit.

Figure 2:
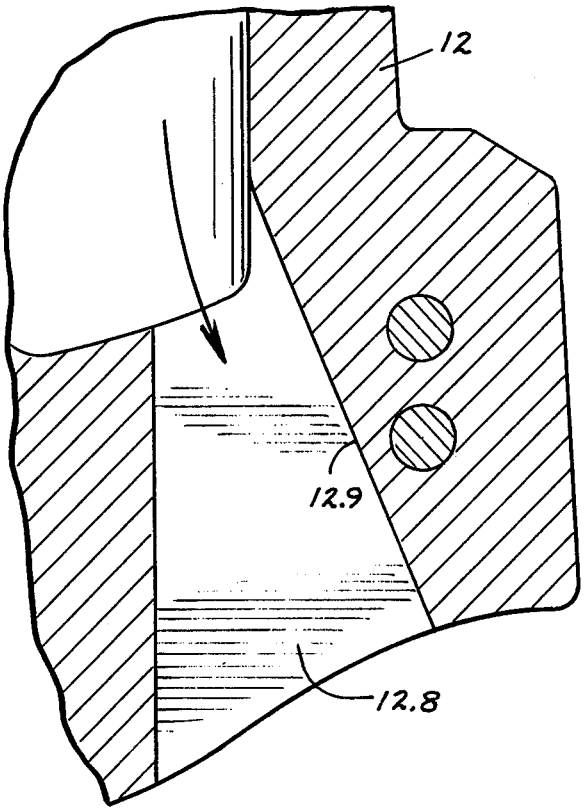
FIG. 2 is a broken away, cross-sectional view taken along line 2—2 of FIG. 1.

With reference now to FIG. 1, it is known in the art that drill bits of the general type described may be manufactured by separately manufacturing the respective journals, and then welding the journals together (as shown by the weld line 12.7) to make the bit complete, the threads thereafter being formed at the top extension of the bit as shown in FIG. 1. Various internal nozzles are generally employed to force air downwardly generally towards the center of the bore hole for the purpose of blowing drill cuttings from the bottom of the hole. In general, it has been my observation that such air blast nozzles in the prior art have tended to do little other than stir up cuttings at the bottom of the bore hole. In the present invention, I provide the mating surfaces of adjacent journals with elongated grooves such that when the journals are assembled together, slots such as that depicted at 12.8 are formed by mating grooves to provide air blast passages downwardly through the journal bodies and outwardly between the conical cutters toward the floor of the bore hole. As shown best in FIG. 2, I prefer that the outer edges 12.9 of such slots be angled downwardly and outwardly slightly so that the jet of air or other material tends to sweep cuttings not only from the surfaces of the conical cutters, but particularly in a generally radially outward direction on the floor of the bore hole, the cuttings thus tending to accumulate about the periphery of the bore hole from whence they can easily escape upwardly between the journals in the usual fashion.

The drill bit of the invention is particularly useful for drilling through hard rock formations, such as taconite. The drill bit of my invention causes axial loads to be taken up at least initially by the hard bearing surfaces rather than by the internal antifriction bearings, and may utilize drill cuttings at the bottom of the drilled hole as a lubricant between the hard bearing surfaces. By employing pairs of cooled bearing surfaces, of which one pair is spaced slightly when the other pair is in bearing contact, the life of the drill bit is increased.

While I have described a preferred embodiment of the present invention, it should be understood that various changes, adaptations, and modifications may be made therein without departing from the spirit of the invention and the scope of the appended claims.

What is claimed is:

1. A rotary drill bit highly resistant to failure from axial loading and comprising a body with a projecting journal, a conical cutter having an axially recessed open end receiving the journal, and interior antifriction bearings rotatably mounting the cutter to the journal for rotation of the cutter about its axis, the rim of the conical cutter and the adjacent drill bit body having respective outer large, hard annular bearing layers providing bearing surfaces in sliding relationship with one another at the open end of the cutter and substantially normal to its axis of rotation, a plurality of grooves in the surface of the annular bearing layer on said cutter, said grooves extending across said annular bearing layer whereby heat generated by friction between said hard bearing surfaces may be easily transferred to the environment of the hole being drilled to cool said surfaces.

2. The rotary drill bit of claim 1 wherein the radial width of the hard outer bearing surfaces of the drill bit body engaging the hard bearing surface at the cutter rim is at least about 15% of the maximum outer diameter of the journal received in the cutter.

3. The rotary drill bit of claim 1 wherein the outer bearing surfaces are of substantially equal hardness.

4. The rotary drill of claim 1 wherein the interior antifriction bearings adjacent the open end of the cutter are roller bearings and said roller bearings are contained in a radially inwardly opening groove in the cutter.

5. A rotary drill bit highly resistant to failure from axial loading and comprising a body with a projecting journal, a conical cutter having an axially recessed open end receiving the journal, and interior antifriction bearings rotatably mounting the cutter to the journal for rotation of the cutter about its axis, the rim of the conical cutter and the adjacent drill bit body having respective outer large, hard annular bearing layers providing bearing surfaces in sliding relationship with one another at the open end of the cutter and substantially normal to its axis of rotation, and the cutter and journal also having inner, spaced but facing respective hard bearing surfaces interiorly of the open end of the cutter and substantially normal to its axis of rotation, the latter surfaces being spaced apart a predetermined distance so as to come into sliding contact with each other as the first-mentioned bearing layers become worn in a drilling operation.

6. The rotary drill bit of claim 5 wherein the interior recess of the conical cutter terminates axially inwardly in one of said inner hard surfaces and wherein the journal terminates inwardly of the cutter in the other of said inner hard surfaces.

7. The rotary drill bit of claim 5 wherein the outer bearing surfaces have a bearing contact area at least 200% greater than the bearing contact area of the inner bearing surfaces.

8. The rotary drill bit of claim 5 wherein the bit is provided with annular races within which are mounted the antifriction bearings and which are so constructed and arranged as to permit axial displacement of the cutter with respect to the journal in an amount at least equal to the spacing between the inner hard bearing surfaces.

9. The rotary drill bit of claim 5 including, as interior antifriction bearings, a ring of ball bearings retaining the cutter on the journal, the journal and cutter having opposed, axially elongated races offset from one another a sufficient amount to permit the cutter to move axially upon the journal as said bearing surfaces become worn, the elongated races being so dimensioned as to engage the ball bearings with an axial load after the conical cutter has moved axially of the journal a predetermined distance.

10. A rotary drill bit highly resistant to failure from axial loading and comprising a body with a projecting journal, a rolling conical cutter having an axially recessed open end receiving the journal and having intentionally recessed roller bearing races, and interior antifriction bearings including roller bearings in said races and mounting the cutter to the journal for rotation about the axis of the cutter, the conical cutter and the body having respective outer hard annular bearing layers defining bearing surfaces in sliding relationship to each other at the open end of the cutter and normal to the cutter axis, the hard bearing surface of the cutter at its open end rim having a plurality of outwardly open, radial grooves thereacross, the axial internal recess of the conical cutter terminating axially inwardly at an inner hard surface normal to its axis and the journal terminating inwardly of the cutter in an inner hard surface confronting but spaced from the inner hard surface of the cutter by a distance less than the thickness of the hard bearing layers at the open end of the cutter, the journal having an axial fluid passage therethrough for conveying a drilling fluid to the space between the internal bearing surfaces, from whence the fluid may pass across the internal antifriction bearings for escape through said radial grooves, said antifriction bearings and their races being so constructed and arranged as to permit axial displacement of the cutter on the journal in an amount at least equal to the spacing between the internal bearing surfaces.

11. Method of drilling a hole through hard rock strata comprising providing a rotary drill bit including a body with a projecting journal and a conical cutter having an axially recessed end and mounted to the journal by internal antifriction bearings, the journal and cutter having mutually facing, large bearing surfaces in sliding, bearing contact at the open end of the cutter and the bearing surfaces having a hardness substantially greater than the rock strata to be drilled, the surface of said cutter having grooves therein which come into overlying, relationship with the opposed bearing surface as the cutter is rotated, and during the well drilling procedure, passing a cooling fluid through the grooves to cool the opposed bearing surface.

12. The method of claim 11 in which both of the bearing surfaces are provided with grooves overlying the opposed bearing surfaces, the method including the step of passing cooling fluid through the grooves in each surface to cool the mutually opposing surfaces.

13. The method of claim 11 in which the conical cutter and the journal are provided with a second set of mutually facing bearing surfaces internally of the cutter, the latter surfaces each being provided with grooves overlying the opposed bearing surfaces, the longitudinal clearances of the large earing surfaces being initially lesser than said second set of bearing surfaces, the method including the step of passing a cooling fluid through the grooves and each of the surfaces to cool the mutually opposing surfaces.

14. The method of claim 13 in which both of the bearing surfaces are provided with grooves overlying the opposed bearing surfaces, the method including the step of passing cooling fluid through the grooves in each surface to cool the mutually opposing surfaces.

15. Drilling method comprising:

providing a rotary drill bit including a body with a projecting journal and a conical cutter having an axially recessed end and mounted onto the journal by interior antifriction bearings, the journal and cutter having outer mutually facing large hard bearing surfaces in sliding, bearing contact at the open end of the cutter and having inner, mutually facing but spaced, hard bearing surfaces interiorly of the conical cutter, all said hard bearing surfaces being generally normal to the axis of rotation of the cutter; and drilling with the drill bit until the outer bearing surfaces have worn away a sufficient amount to bring the inner bearing surfaces into sliding, bearing contact with one another.

16. A rotary drill bit highly resistant to failure from axial loading and comprising a body having a plurality of projecting journals, a like plurality of conical cutters each having an axially recessed open end receiving a journal, and interior antifriction bearings rotatably mounting the cutter to the journal for rotation of the cutter about its axis, the drill bit body including at least one generally downwardly oriented and radially elongated slot therein directed between adjacent conical cutters and configured to direct a fluid between the cutters and onto the floor of a bore hole to sweep drill cuttings generally outwardly toward the periphery of the bore hole being drilled.

17. A rotary drill bit highly resistant to failure from axial loading and comprising a body having a plurality of projecting journals, a like plurality of conical cutters each having an axially recessed open end receiving a journal, and including interior antifriction bearings rotatably mounting the cutter to the journal for rotation of the cutter about its axis, the rim of each conical cutter and the adjacent drill bit body having respective outer large, hard annular bearing layers providing bearing surfaces in sliding relationship with one another at the open end of the cutter and substantially normal to its axis of rotation to facilitate the transfer of heat generated by friction between the bearing surfaces to the environment of the hole being drilled; the drill bit body comprising at least one generally downwardly oriented and radially elongated slot positioned to direct a fluid between adjacent conical cutters and against the floor of the hole being drilled to sweep drill cuttings generally toward the periphery of the hole.

* * * * *